US012604933B1

(12) United States Patent
Yes

(10) Patent No.: US 12,604,933 B1
(45) Date of Patent: Apr. 21, 2026

(54) CHEST BINDER

(71) Applicant: euphorm LLC, Philadelphia, PA (US)

(72) Inventor: Eppchez Yes, Philadelphia, PA (US)

(73) Assignee: euphorm LLC, Philadelphia, PA (US)

( * ) Notice: Subject to any disclaimer, the term of this patent is extended or adjusted under 35 U.S.C. 154(b) by 168 days.

(21) Appl. No.: 18/611,786

(22) Filed: Mar. 21, 2024

Related U.S. Application Data

(60) Provisional application No. 63/491,571, filed on Mar. 22, 2023.

(51) Int. Cl.
*A41C 3/00* (2006.01)

(52) U.S. Cl.
CPC ..... *A41C 3/005* (2013.01); *A41C 3/0007* (2013.01)

(58) Field of Classification Search
CPC ..... A41C 3/0007; A41C 3/005
USPC ..... 450/59
See application file for complete search history.

(56) References Cited

U.S. PATENT DOCUMENTS

| | | | | |
|---|---|---|---|---|
| 4,220,157 | A | 9/1980 | Clark | |
| 6,280,287 | B1 * | 8/2001 | Keith | A41F 15/002 450/41 |
| 6,296,618 | B1 | 10/2001 | Gaber | |
| 7,909,675 | B1 * | 3/2011 | Rainey | A41C 3/02 450/59 |
| 9,826,783 | B2 | 11/2017 | Washington et al. | |
| 10,555,562 | B2 | 2/2020 | Poirer | |
| 2008/0287770 | A1 * | 11/2008 | Kurzweil | A61B 5/0295 600/388 |
| 2013/0065486 | A1 * | 3/2013 | Hansen | A41C 3/0064 450/59 |

* cited by examiner

*Primary Examiner* — Gloria M Hale
(74) *Attorney, Agent, or Firm* — Blank Rome

(57) ABSTRACT

A chest binder to secure chest tissue of a wearer in a position that spreads the chest tissue outwards from the sternum towards respective sides of a body of the wearer, all to flatten a chest profile of the wearer. The chest binder can include a band configured to extend across a back of and around each side of the wearer, and partially across a front of the wearer. Also included are two straps, where a portion of each strap loop is attached to the band. Each strap can be configured to extend over a shoulder of the wearer, down the back of the wearer, around a side of, and under an arm of, the wearer, and under and around chest tissue of the wearer, thereby supporting the chest tissue while the band flattens the chest tissue of the wearer.

9 Claims, 9 Drawing Sheets

CHEST BINDER

RELATED APPLICATION

This application claims benefit of priority of U.S. Provisional Application No. 63/491,571, filed Mar. 22, 2023, entitled Chest Binder. The above-identified related application is incorporated herein by reference.

FIELD OF THE INVENTION

The present disclosure relates to chest binder. More particularly, the present disclosure relates to a chest binder that secures chest tissue of a wearer in a position that spreads the chest tissue outwards from the sternum towards respective sides of a body of the wearer, all to flatten a chest profile of the wearer.

BACKGROUND OF THE INVENTION

Chest binders are "life-saving" for the transgender community. "According to a landmark study on binding practices in the transgender community, roughly 70 percent of surveyed individuals report a positive mood after starting to bind, compared to only about 7 percent who reported having a positive mood before binding."

Current chest binders, however, compress chest tissue directly into the body, impacting the ribs, lungs, and upper back. This compressing action "can cause serious side effects-back and chest pain, rib bruising and fractures, shortness of breath, overheating, and musculoskeletal damage." (Moffa, Jamie. Chest Binding: A Physician's Guide, https://www.prideinpractice.org/articles/chest-binding-physician-guide; Apr. 6, 2019). In a survey of 1800 individuals who had experience with chest binding, "over 97% reported at least one of 28 negative outcomes attributed to binding." (Peitzmeier S, Gardner I, Weinand J, Corbet A, Acevedo K.; Health impact of chest binding among transgender adults: a community-engaged, cross-sectional study. Cult Health Sex. 2017 January; 19 (1): 64-75. doi: 10.1080/13691058.2016.1191675. Epub 2016 Jun. 14. PMID: 27300085).

The chest binding garment of the present disclosure addresses these negative outcomes while maintaining the positive outcomes associated with chest binding for transmasculine individuals. Further, the positive impacts of the present chest binding garment may go beyond the gender-nonconforming community. Many cisgender women opt for breast reduction surgery due to the negative impacts of carrying large chest tissue on their bodies. The present chest binding garment has the capability of improving the daily life for those who wish to minimize their chest size, and reduce back problems frequently associated with large chest size.

SUMMARY OF THE INVENTION

The present disclosure is a chest binding garment (chest binder) worn to flatten a profile of the chest of a wearer. More particularly, the chest binder secures chest tissue of a wearer in a position that spreads the chest tissue outwards from the sternum towards respective sides of a body of the wearer.

In one aspect, the chest binder includes a band configured to extend across a back of a wearer, around each side of the wearer, and at least partially across a front of the wearer. Also included are two straps, where a portion of each strap loop is attached to the band. In this aspect, each strap can be configured to extend over a shoulder of the wearer, down the back of the wearer, around a side of, and under an arm of, the wearer, and under and around chest tissue of the wearer, thereby supporting the chest tissue of the wearer while the band flattens the chest tissue of the wearer. Each strap could comprise a complete strap loop.

To flatten the chest tissue of the wearer, the band can be configured to spread chest tissue outwards, away from a sternum of the wearer, towards respective sides, and towards each underarm, of the wearer. Each strap can further include gripping material on a side of the strap configured to make contact with a body of the wearer.

In this aspect, the portion of each strap loop attached to the band can be fixedly attached to the band at a respective end of the band. Each strap loop can be additionally and movably attached to the band by placement of each strap loop through a garment loop secured on the band. Each garment loop can be located on an inside of a back of the band, so the two garment loops are configured to be located on either side of a spine of the wearer, each in a vicinity of a shoulder blade of the wearer.

Also in this aspect, the band can include two ends, each end of the band configured to be located, when worn, on a front of, and on either side of a sternum of, the wearer. The two ends of the band can be attached by a closure, or can remain unattached. The closure can be configured for location below a solar plexus of the wearer. Further, the portion of each strap configured to extend around a side of, and under an arm of, the wearer, and under and around chest tissue of the wearer, can be configured to be located under the band, between a body of the wearer and the band.

In another aspect, the chest binder includes a band configured to extend across a back of a wearer, around each side of the wearer, and at least partially across a front of the wearer. Also included are two straps, where a portion of each strap is attached to the band. In this aspect, each strap can be configured to extend over a shoulder of the wearer, down the back of the wearer, around a side of, and under an arm of, the wearer, and under and around chest tissue of the wearer. Further, the portion of each strap configured to extend around a side of, and under an arm of, the wearer, and under and around chest tissue of the wearer, can be configured for location under the band, between a body of the wearer and the band, whereby the chest tissue of the wearer is supported by each strap while the overlying band flattens the chest tissue of the wearer.

To flatten the chest tissue of the wearer, the band can be configured to spread chest tissue outwards, away from a sternum of the wearer, towards respective sides, and towards each underarm, of the wearer. Each strap can further include gripping material on a side of the strap configured to make contact with a body of the wearer.

In this another aspect, the portion of each strap attached to the band can be fixedly attached to the band at a respective end of the band. Each strap can be additionally and movably attached to the band by placement of each strap through a garment loop secured on the band. Each garment loop can be located on an inside of a back of the band, the two garment loops are configured to be located on either side of a spine of the wearer, each in a vicinity of a shoulder blade of the wearer.

Also in this another aspect, the band can include two ends, each end of the band configured to be located, when worn, on a front of, and on either side of a sternum of, the wearer. The two ends of the band can be attached by a closure, or can remain unattached. The closure can be configured for location below a solar plexus of the wearer. Further, each strap can form a complete strap loop.

BRIEF DESCRIPTION OF THE ILLUSTRATED EMBODIMENTS

The present disclosure will be better understood with reference to the following description taken in combination with the drawings. For the purpose of illustration, there are shown in the drawings certain embodiments of the present disclosure. It should be understood, however, that the disclosure is not limited to the precise arrangements, dimensions, and instruments shown:

DETAILED DESCRIPTION OF THE ILLUSTRATED EMBODIMENTS

Figure 9:
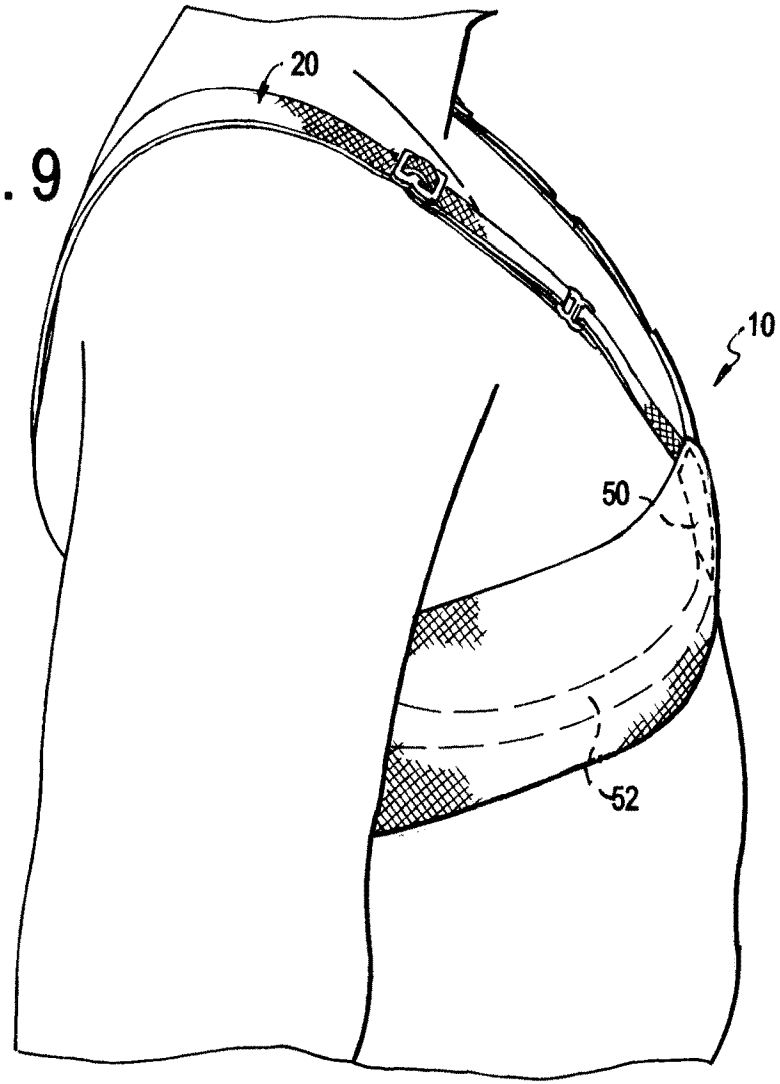
FIG. 9 illustrates a side view of the chest binder of FIG. 1, in a final wearing position.

Reference will now be made in detail to embodiments of the disclosure, examples of which are illustrated in the accompanying drawings. The terminology used in the description of the disclosure herein is for the purpose of describing particular embodiments only and is not intended to be limiting of the disclosure.

As used in the description of the disclosure and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises," "includes," and/or "comprising," "including," when used in this specification, specify the presence of stated features, integers, steps, elements, and/or components, but do not preclude the presence or addition of one or more other features, integers, steps, elements, components, and/or groups thereof.

The words "top," "bottom," "left," "right, "front," "back," "side," "lower," "upper," "over," and "under," designate relative portions of the product when the product is arranged as worn on a body of a wearer. The terminology includes the words noted above, derivatives thereof and words of similar import.

Referring to the drawings, where like numerals indicate like elements throughout, there is shown in FIGS. 1-9 a first embodiment of a chest binding garment, generally designated 10, and hereinafter referred to as the "chest binder" 10 in accordance with at least one embodiment of the present disclosure. The chest binder 10 secures chest tissue of a wearer in a relative position that spreads the chest tissue outwards from the sternum towards respective sides (and towards the underarm) of a body of the wearer.

In one aspect, the chest binder includes two loops of narrow elastic, or straps 20, each attached to a band 30 made of suitable fabric. Each strap 20 can form a complete, circular loop (see FIGS. 1, 2). A portion (or length) of each circular strap loop is attached (e.g., stitched) to an end 32 of the band 30 (see FIGS. 1, 8). The band 30 is wider than each strap 20, may vary in width W, along its length L, and may be wider, or narrower, in a middle 34 of the band 30 (see FIG. 2). When worn, the middle 34 of the band 30 would be located in a middle portion of a back of the wearer, and each end 32 of the band 30 would be located on a front of, and on either side of a sternum of, the wearer (see FIGS. 6-8).

Figure 1:
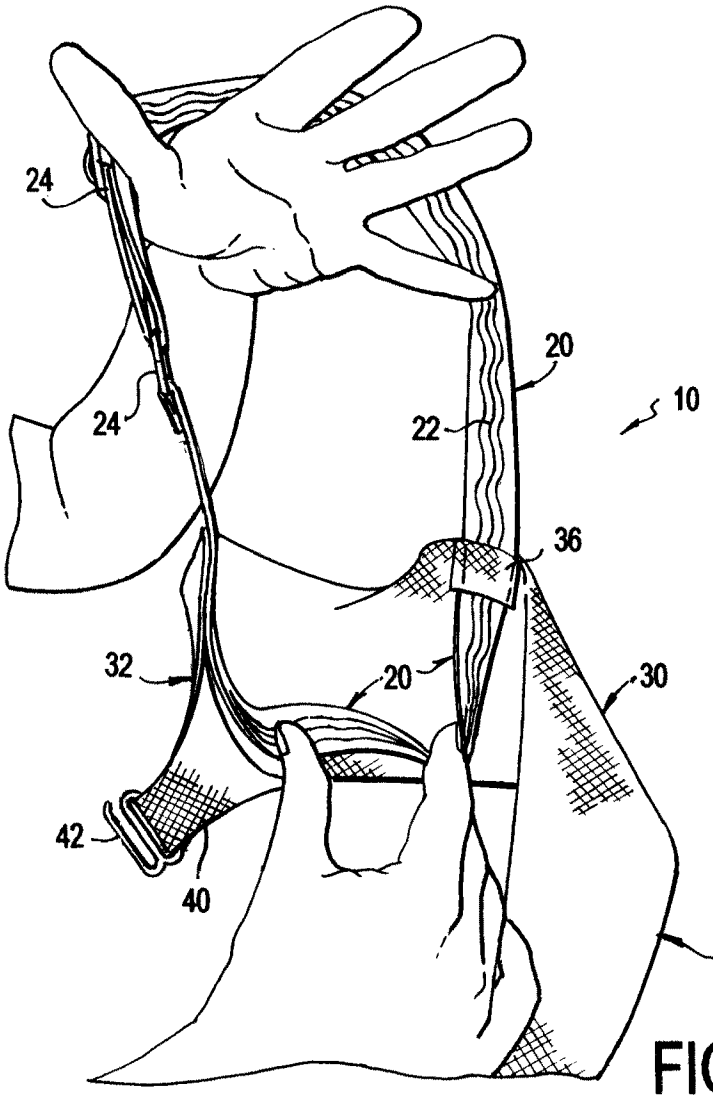
FIG. 1 illustrates a perspective view of one embodiment of a chest binder of the present disclosure, draped to show features thereof, for example, one of two straps and a band.

The straps 20 may have tacky, gripping material 22 (laminated or otherwise attached to the strap) on a side of the strap that makes contact with a body of a wearer (see FIG. 1). The gripping material 22 could be a silicon tacking material. A length of each strap 20, and a width W of the band 30, may vary based on garment sizing (considering wearer size). Lengths may also be adjustable. For example, one or more buckles 24 can be provided on each strap 20 for individual length adjustment.

Figure 4:
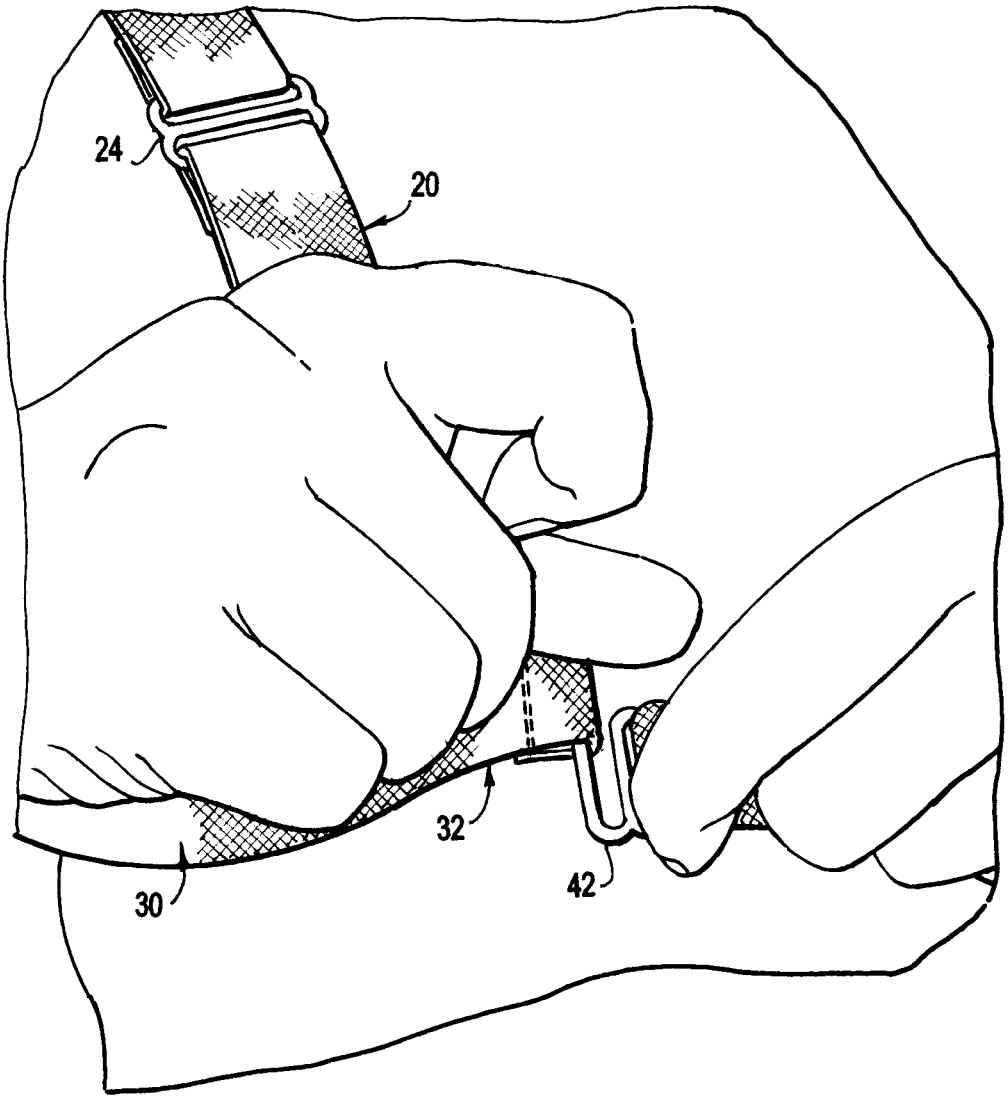
FIG. 4 illustrates the chest binder of FIG. 1, being attached at a front of the wearer.
Figure 5:
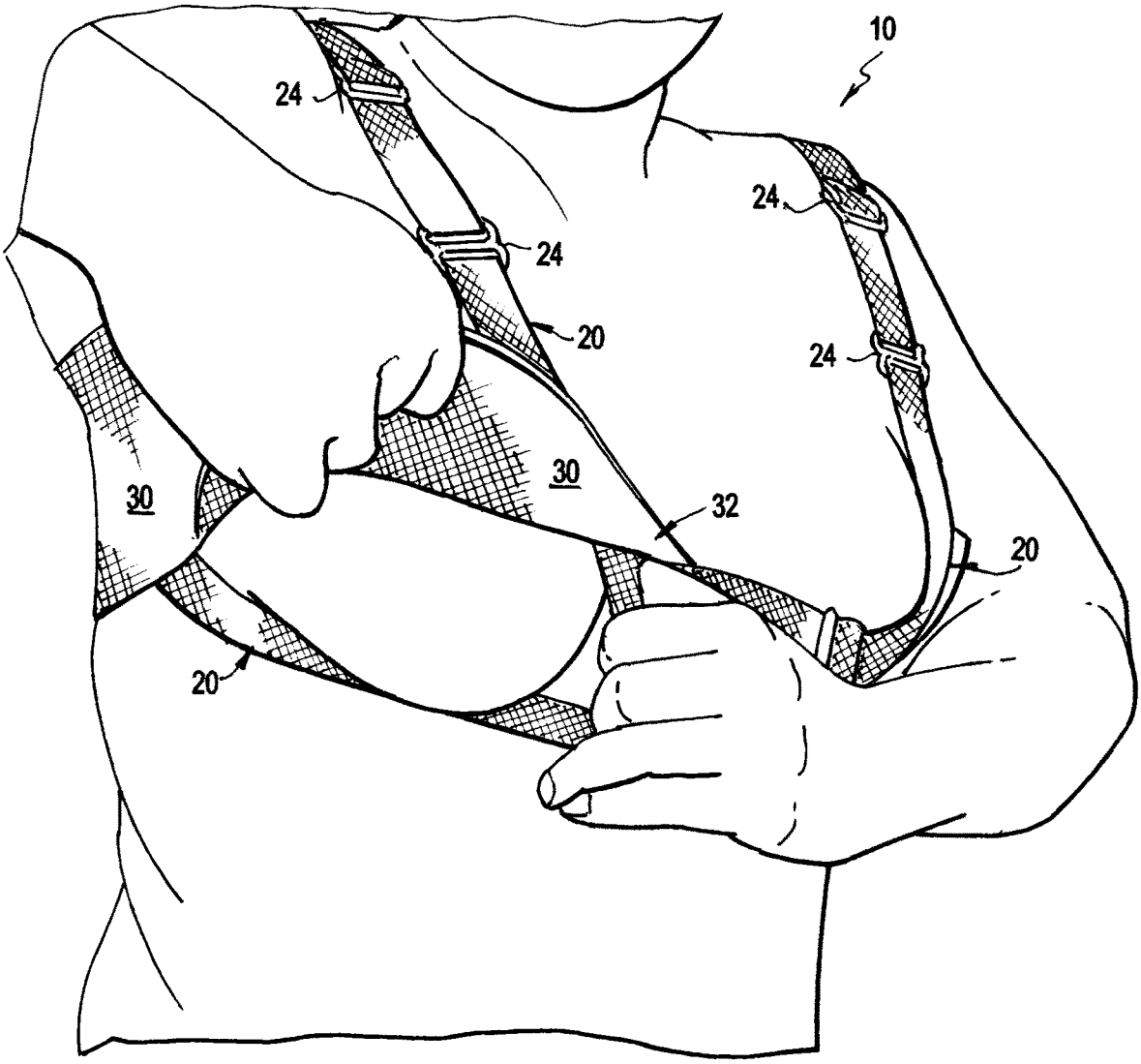
FIG. 5 illustrates the chest binder of FIG. 1, showing the strap under and around a chest tissue of the wearer, and the band to be placed thereover.
Figure 6:
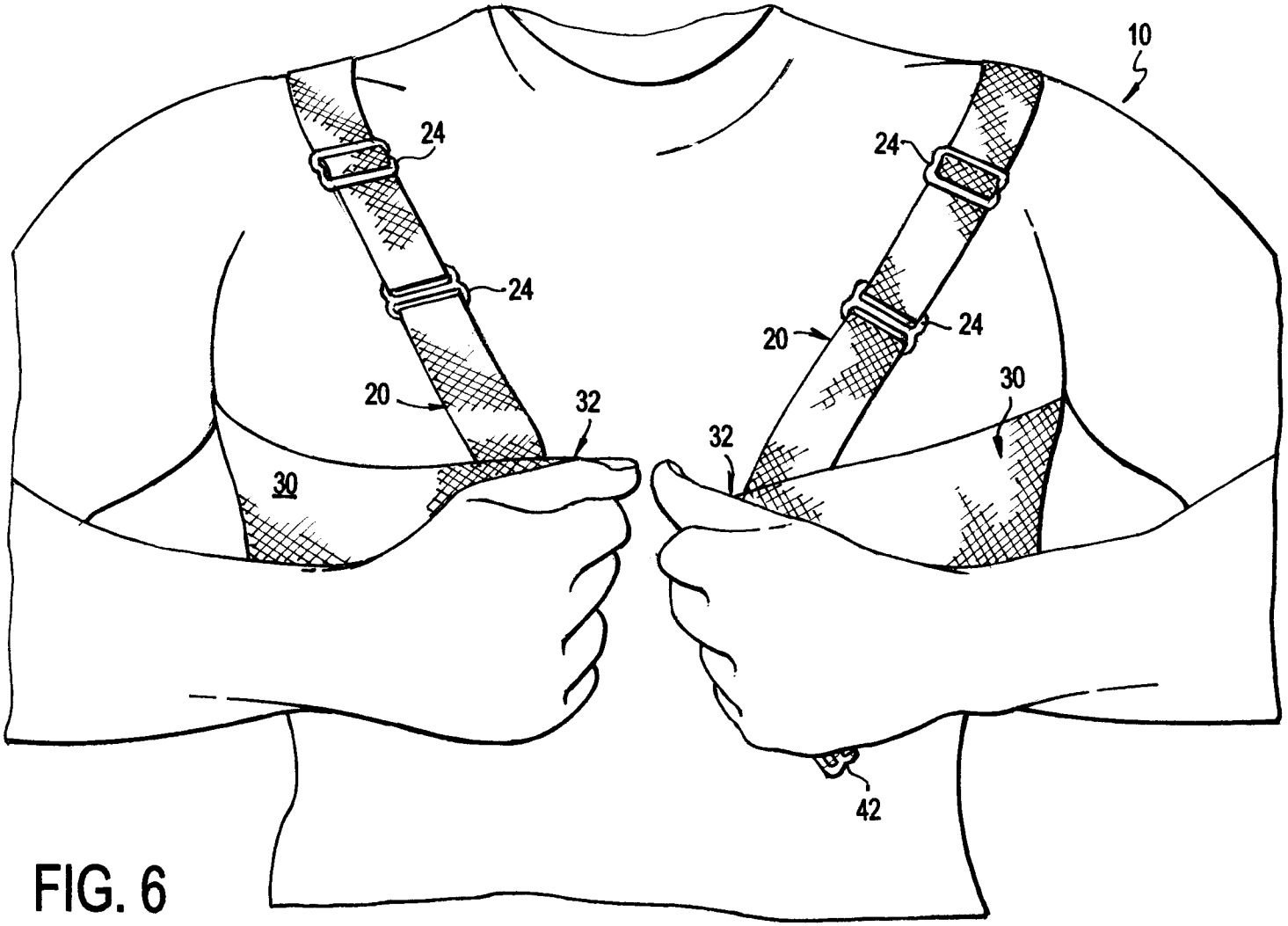
FIG. 6 illustrates the chest binder of FIG. 1, draped over the shoulders of a wearer, with the band extending around the sides of the wearer, with the chest binder ready for attachment in the front of the wearer.

The straps 20 are configured to encircle a shoulder and chest (breast) tissue of the body of the wearer (see FIG. 5). For example, each strap 20 is configured to extend over the shoulder of the wearer, down the back, around a respective side (under an arm), and then under and around (thereby supporting) the chest tissue of the wearer (see FIGS. 3-5).

Figure 2:
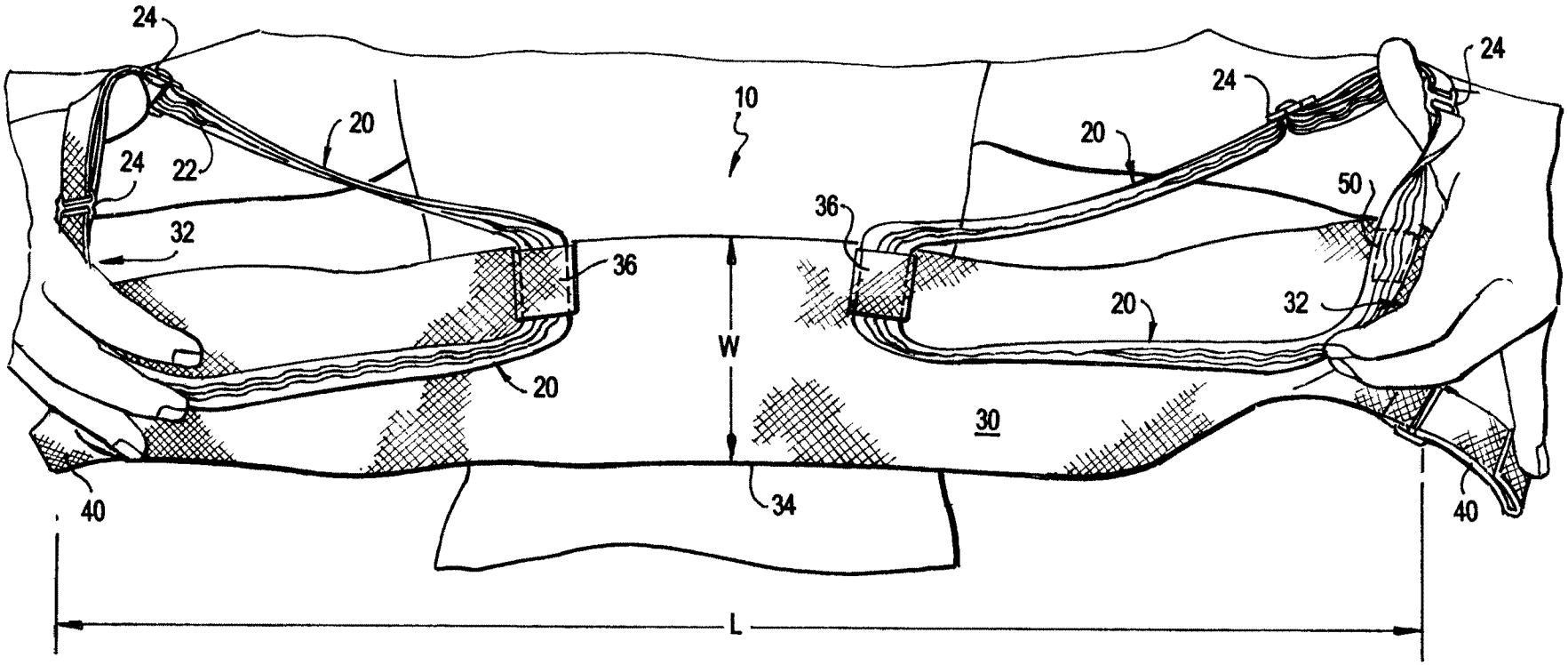
FIG. 2 illustrates an extended, horizontal view of the chest binder of FIG. 1.
Figure 3:
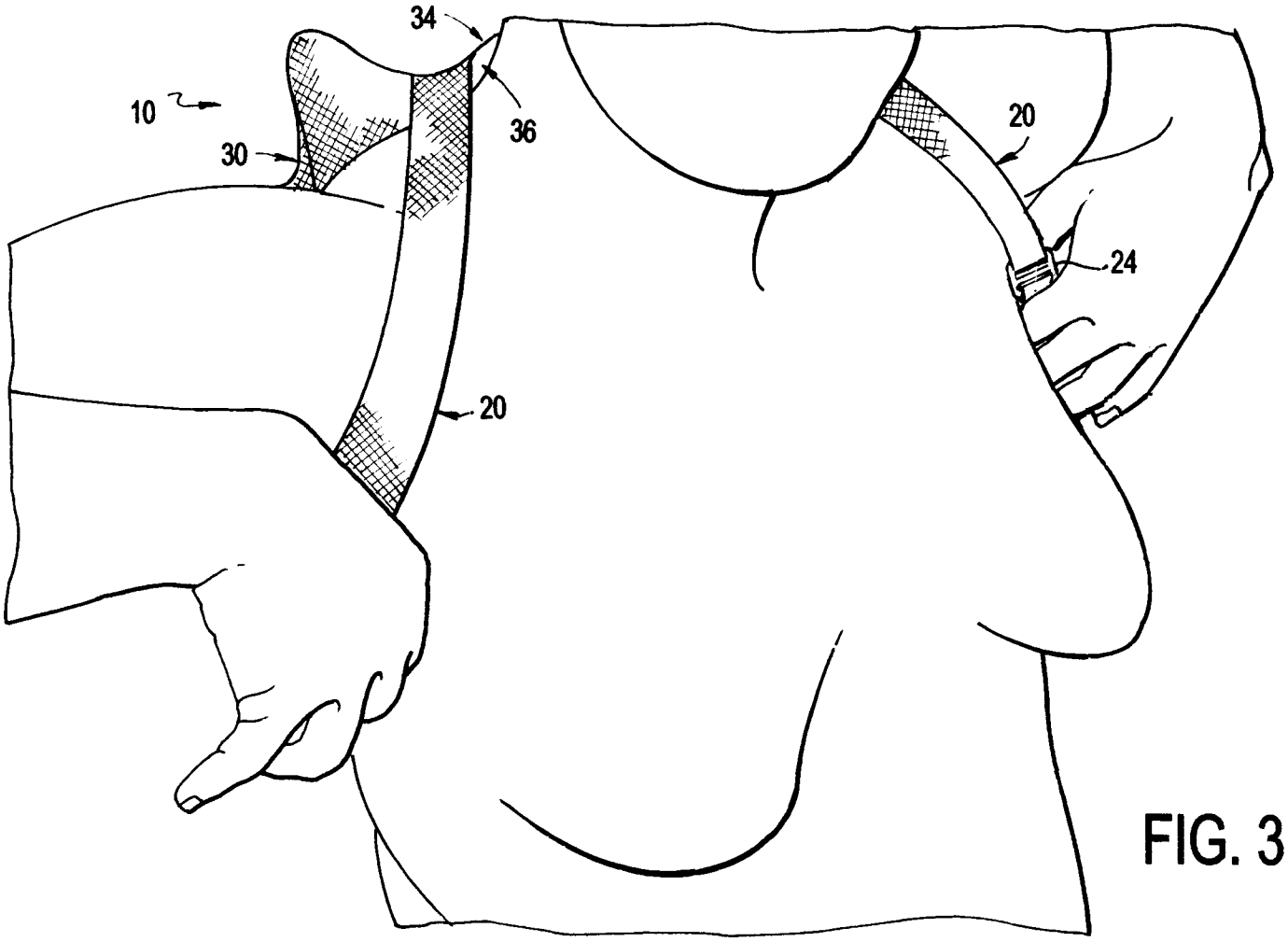
FIG. 3 illustrates the chest binder of FIG. 1, draped over the shoulders of a wearer during placement of the chest binder on the wearer.

Each strap 20 can also be movably secured to the band 30 at a second location, on either side of a spine of the wearer, located in a vicinity of a shoulder blade of the wearer. In one embodiment, each strap 20 passes through a secured garment loop 36 located on an inside of the band 30 (FIGS. 1-3).

Figure 7:
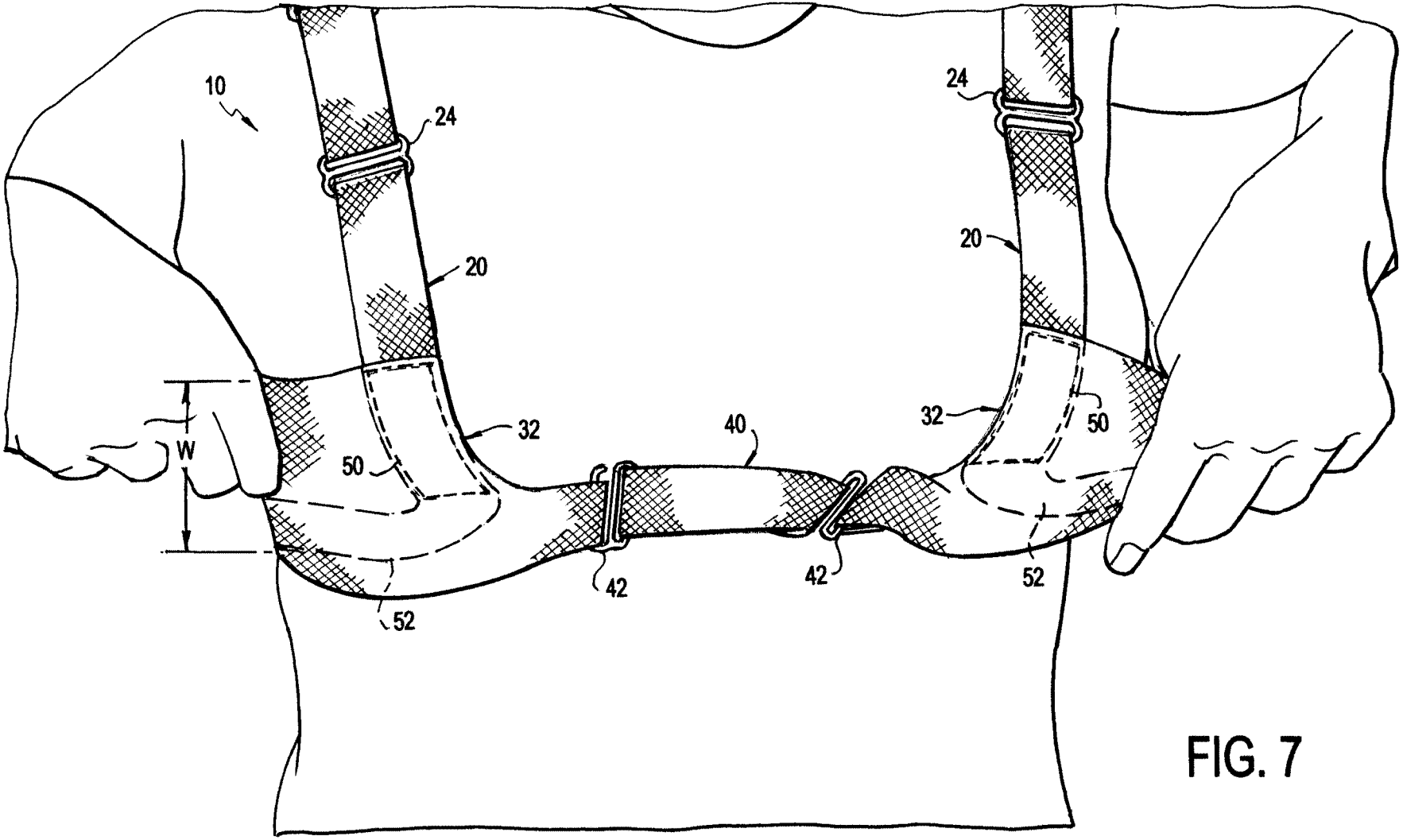
FIG. 7 illustrates the chest binder of FIG. 1, in a wearing position, with the wearer (using thumbs) adjusting chest tissue relative to a portion of each strap underlying the band.
Figure 8:
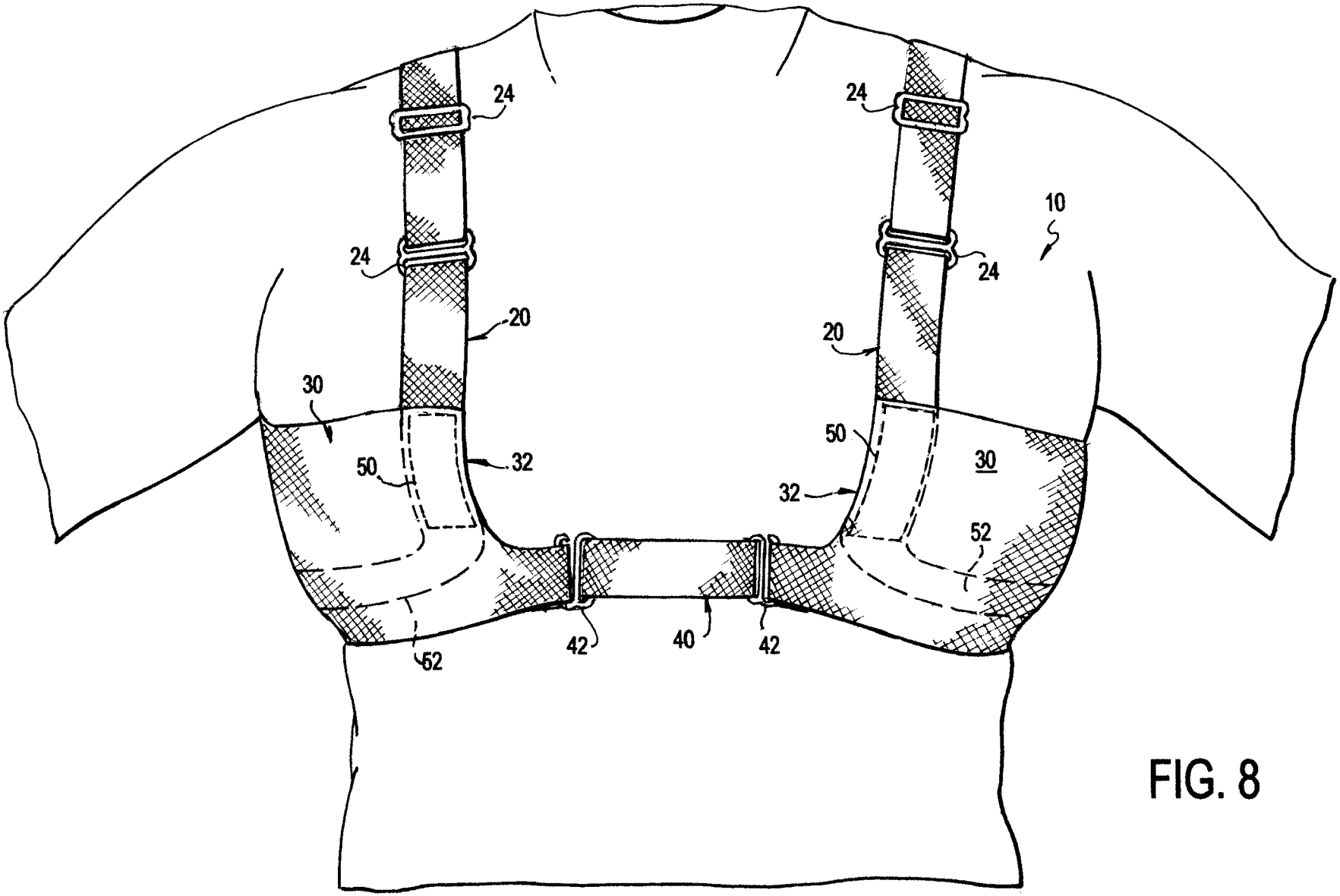
FIG. 8 illustrates a front view of the chest binder of FIG. 1, in a final wearing position.

The band 30 is configured to extend across the back and chest of the wearer, with the ends 32 of the band 30 attaching on either side of a sternum of the wearer (see FIGS. 7-9). For example, the band 30 is configured to extend across the back of the wearer, around each side (under an arm), and then to be attached across the sternum of the wearer (see FIGS. 4-9).

As can be appreciated from the explanation above, from FIG. 5, and as shown by dashed lines 52 in FIGS. 7, 9, the portion of the strap 20 loop that does not extend over the shoulder of the wearer, or down the front or back of the wearer, is located under the band 30, in a final, wearing configuration of the chest binder 10. That is, the portion of the strap 20 loop extending from the back of the wearer (beginning at the garment loop 36), down and around each side (i.e., under each arm) of the wearer, and then under and around the chest tissue of the wearer (FIG. 5), to support the chest tissue while the band 30 acts to spread the chest tissue outwards, away from the sternum, and towards respective sides of (under each arm of) the wearer, is located under the band 30 (i.e., between a body of the wearer and the band), in a final, wearing configuration of the chest binder 10.

In many instances, the band 30 need not be attached across a front of the wearer (as shown attached in FIG. 7). The chest binder 10 will stay secured via the strap and band arrangement, without connection of the two ends 32 of the band 30. Lack of attachment may be desired for fashionable purpose (e.g., to facilitate a wearing of an open, low-cut top).

When respective ends 32 of the band 30 are secured together in a front of the wearer, a clasp or closure 40 can be provided (FIG. 7). The closure 40 can include a short length of extension strap (made of any material), with one or two buckles 42 at each end thereof, to provide easy removable attachment. The one or two buckles 42 could include know closures, hoops, buckles, barrel clasps, Velcro® attachments, etc. Or, the closure 40 can be fixedly attached (e.g., stitched) at one end 32 of the band 30, with a buckle 42 at an other end 32 of the closure 40. The closure 40 is preferably located just below a solar plexus of the wearer. In one aspect, this is best achieved with a closure 40 located at a lower, or bottom, portion of the band 30 (as shown in FIG. 7). However, any arrangement of one or more extension straps can be provided as a closure 40, the one or more straps being located in any top to bottom location (relative to respective ends 32 of the band 30), to provide various functional or fashionable purpose. Through the use of variously placed buckles 42, the closure 40 may be adjustable in length.

As detailed earlier, in one embodiment, each strap 20 forms a complete loop (see FIGS. 1, 2), and a portion (or length) of each strap loop is attached (e.g., stitched) to an end 32 of the band 30 (see FIGS. 1, 7, 8). In one embodiment, each strap 20 is secured to the band (e.g., stitched) as shown by dotted lines 50 in FIGS. 7-9.

The portional length of each strap 20 loop that is secured to the band 30 can vary. In certain embodiments, if the band 30 is two (2) to four (4) inches wide W, each strap 20 could be attached to a top three (3) inches of the band 30, immediately at, and along, the end 32 of the band 30 (FIG. 7). If the band 30 is six (6) to eight (8) inches wide W, each strap 20 could be attached to a top four (4) inches of the band 30, immediately at, and along, the end 32 of the band 30 (FIG. 7).

Alternatively, the length of each portion of the strap 20 fixedly attached (e.g., stitched) to the band 30 (i.e., a length of dotted line portion 50, as shown in FIG. 7) could be removed, with the respective strap 20 just being fixedly attached to the band 30 in a location approximate the top and bottom of the dotted line portion 50 on the band 30. Although the physical strap 20 portion could be removed over the length of this dotted line portion 50, due to the strap 20 being fixedly attached over this length, having this length of strap 20 remain provides additional support to the band 30 over this length. It is understood that, if the length of either strap 20 were not to remain over any length of fixed attachment to the band 30, the respective strap 20 would not, technically, form a complete, circular loop on the chest binder 10 (but would still form a complete, circular loop in overall function and spirit).

To wear the chest binder 10 of the present disclosure, a wearer would first put each arm through a long (larger) part of each strap 20 loop (FIGS. 1, 2), so that the straps 20 extend over the shoulders of the wearer, so that the chest binder 10 hangs down, and the band 30 extends across a back of the wearer (FIG. 3).

Next, the wearer positions a remainder of the strap 20 loop (i.e., the portion under the band 30) under and around their chest tissue (FIG. 5). The wearer can now fasten the closure 40 at a front of the wearer (FIG. 4). After fastening the closure 40, the wearer can adjust (or reconfigure) their chest tissue within the chest binder 10 to achieve a desirable flattening effect (FIG. 5). During adjustment, the wearer may adjust the underlying strap 20 loop to extend, generally, between the ribs and the excess chest tissue.

One effective way to adjust the chest binder 10 is for the wearer to reach in, under a bottom of the front/side of the band 30, for each breast, and use their hand to rearrange the chest tissue relative to the underlying strap 20 and overlying band 30, adjusting the chest tissue outwards from the sternum towards respective sides (and towards each underarm) of the wearer, allowing pressure from each strap 20 (under and around the chest tissue) and band 30 (over the chest tissue and strap) to secure the chest tissue in place to achieve a desired and flattened chest profile.

Figure 10:
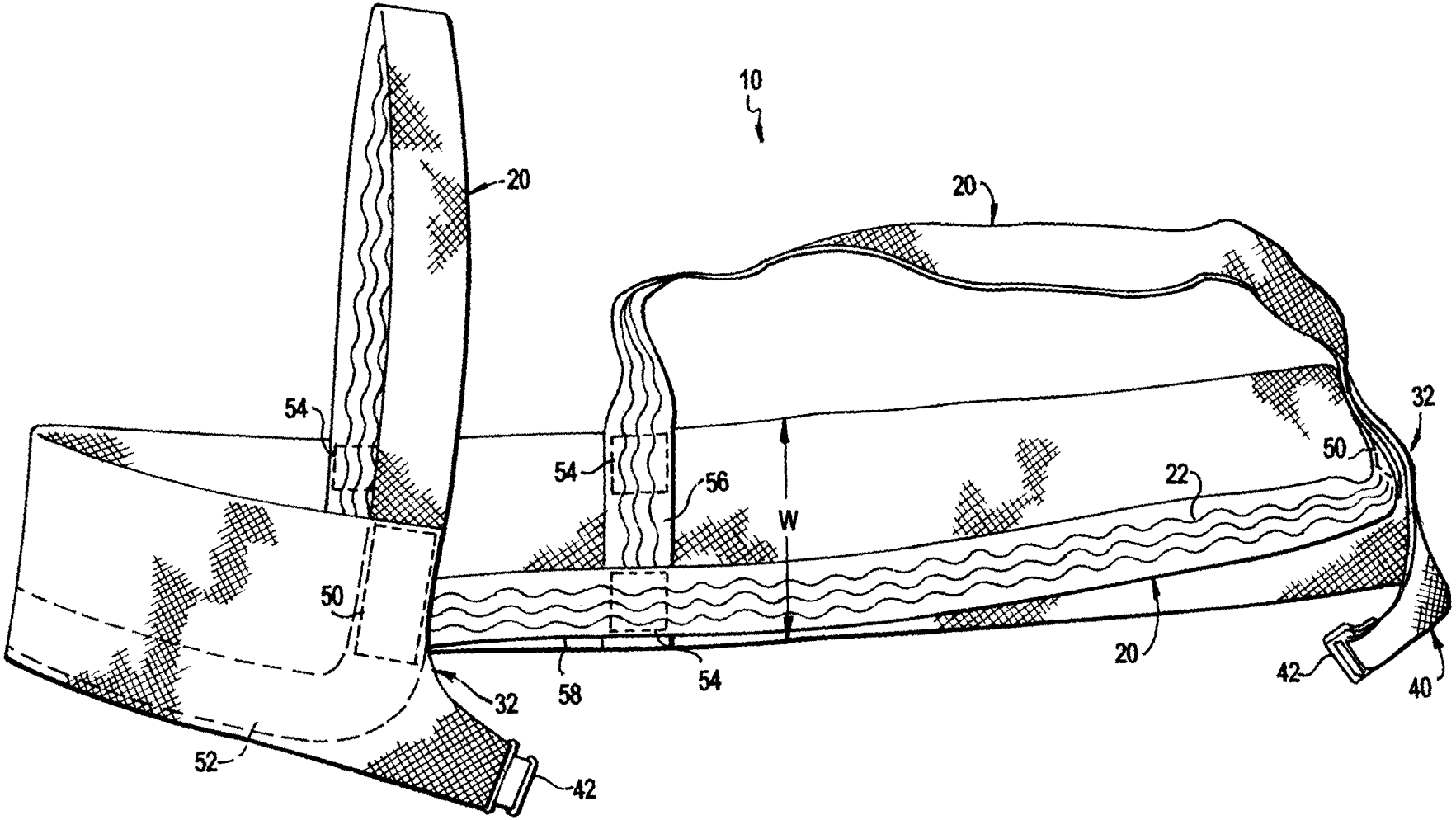
FIG. 10 illustrates an extended, horizontal view of a second embodiment of a chest binder of the present disclosure; showing alternative securement of the straps to the band relative to the chest binder embodiment illustrated in FIG. 1.

FIG. 10 illustrates a second embodiment of the chest binder 10 of the present disclosure. The second embodiment of FIG. 10 is similar to the first embodiment shown in FIG. 1, in many/most feature aspects, as is represented by like numerals indicating like elements throughout.

In the FIG. 10 embodiment, rather than having each strap 20 be movably secured to the band 30 by having each strap 20 pass through a secured garment loop 36 located on an inside of the band 30 (see FIGS. 1-3), each strap is fixedly attached (e.g., stitched) at this location on an inside, back of the band 30, as shown by dotted lines 54 in FIG. 10. In this embodiment, the fixed attachment (e.g., stitching) can occur at a top and a bottom of the band 30, as shown in FIG. 10, or the fixed attachment can occur over an entire vertical length of this strap segment 56 (which spans a length of the width W of the band 30.

Alternatively, as detailed above, the entire strap segment 56 need not be included in this FIG. 10 embodiment, as the respective strap 20, being fixedly attached at a top and bottom of the band 30, as shown in FIG. 10, could end there, with only band 30 material existing inbetween. Such an arrangement is an alternative aspect of the present embodiment. However, because an entire vertical length of this strap segment 56, spanning an entire length of the width W of the band 30, provides improved structural support for the band 30, and the entire chest binder 10, inclusion of this strap segment 56 is viable.

Similarly, a horizontal strap segment 58 is shown in the FIG. 10 embodiment, located between two fixed attachment locations 54 on a lower, inside, back portion of the band 30. This horizontal strap segment 58 may or may not be included as a feature aspect. However, inclusion can provide additional support and stiffness to this portion of the band 30, particularly when a spandex material is used for the band 30.

Either of the two expressly presented chest binder 10 embodiments could include strap 20 material comprising elastic webbing. The band 30 material could be a typically stiff, less elastic fabric, or could be a more elastic synthetic fabric, such as spandex. In one aspect, the band 30 is a two-layer material, where an outside layer comprises ProCool® Compression-FIT Performance Nylon Spandex fabric, and an inside layer (the layer making direct contact with a body of a wearer) comprises ProCool® Performance Interlock CoolMax® fabric.

These and other advantages of the present disclosure will be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications (and the permutational inclusion of the variously disclosed feature elements) that are within the scope and spirit of the disclosure as set forth in the claims.

What is claimed is:

1. A chest binder, comprising:

a band configured to extend across a back of a wearer, around each side of the wearer, and at least partially over chest tissue of the wearer; and at least two straps, wherein a portion of each strap is attached to the band, wherein each strap is configured to extend over a shoulder of the wearer, down the back of the wearer, around a side of the wearer, under an arm of the wearer, and under and around chest tissue of the wearer, thereby supporting the chest tissue of the wearer while the band applies pressure on the chest tissue of the wearer.

2. The chest binder of claim 1, wherein, when the band applies pressure on the chest tissue of the wearer, the band is configured to spread the chest tissue outwards, away from a sternum of the wearer, and towards respective sides of the wearer.

3. The chest binder of claim 1, wherein each strap comprises gripping material on an inside of the strap configured to make contact with the wearer.

4. The chest binder of claim 1, wherein the band includes two ends, and wherein the portion of each strap attached to the band is fixedly attached to the band at a respective end of the band.

5. The chest binder of claim 1, wherein each strap is movably attached to the band.

6. The chest binder of claim 1, wherein the band includes two ends, and each end of the band is configured to be located on a front of the wearer and on a side of a sternum of the wearer.

7. The chest binder of claim 6, wherein the two ends of the band are attached by a closure, and the closure configured to be located below a solar plexus of the wearer.

8. The chest binder of claim 1, wherein a portion of each strap configured to extend around the side of the wearer, under the arm of the wearer, and under and around the chest tissue of the wearer is configured to be located between the wearer and the band.

9. The chest binder of claim 1, wherein each strap comprises a complete strap loop.

* * * * *